US005174415A

United States Patent [19]

Neagle et al.

[11] Patent Number: 5,174,415

[45] Date of Patent: Dec. 29, 1992

[54] WALK BEHIND FORK LIFT TRUCK

[75] Inventors: Paul W. Neagle, Westerville; William R. Dubosh, Columbus; John R. Mauck, Galloway, all of Ohio

[73] Assignee: Teledyne Princeton, Inc., Canada

[21] Appl. No.: 807,998

[22] Filed: Dec. 16, 1991

[51] Int. Cl.[5] ..... B66B 9/20

[52] U.S. Cl. ..... 187/9 R; 414/467; 280/43.23; 180/209

[58] Field of Search ..... 187/9 R, 9 E; 414/347, 414/467, 786; 280/638, 43.23, 43.17; 150/209, 326

[56] References Cited

U.S. PATENT DOCUMENTS

| | | | |
|---|---|---|---|
| 3,799,379 | 3/1974 | Grether et al. | 214/515 |
| 3,972,427 | 8/1976 | Stanley et al. | 214/38 BA |
| 4,061,237 | 12/1977 | Austin et al. | 214/515 |
| 4,460,064 | 7/1984 | Lutz et al. | 287/9 R |
| 4,513,837 | 4/1985 | Archer | 280/43.23 |
| 4,571,139 | 2/1986 | Moseley et al. | 414/347 |
| 4,613,272 | 9/1986 | vom Braucke et al. | 414/347 |
| 4,921,075 | 5/1990 | Schumacher et al. | 187/9 E |
| 4,987,976 | 1/1991 | Dougherty | 187/9 R |
| 5,086,847 | 2/1992 | Meiners | 280/43.23 |

*Primary Examiner*—Robert P. Olszewski
*Assistant Examiner*—Kenneth Noland
*Attorney, Agent, or Firm*—Sidney W. Millard

[57] ABSTRACT

A fork lift truck takes less storage space when its support wheels are raised from operative position to storage position parallel with the mast of the truck. To further minimize the space taken up by the stored truck, the rotation of the wheels upward to inoperative position uses a camming surface which also telescopingly cams the wheel and support arms inward toward the mast.

20 Claims, 6 Drawing Sheets

WALK BEHIND FORK LIFT TRUCK

FIELD OF THE INVENTION

This invention relates to a fork lift truck having its forward support wheels mounted on arms which are rotatable to upright position to minimize the space taken up by the truck during storage.

BACKGROUND OF THE INVENTION

Fork lift trucks come in a variety of sizes and have many and varied specialized functions. One inventive concept of importance herein is the provision of a relatively small-sized truck allowing an operator to walk behind the truck, operating manual controls during normal operations. When the truck is not in use it may be desirable to store it in a way to minimize storage space in the particular manufacturing or warehouse facility where the truck is normally used. Additionally, it may be desirable to mount the small-sized fork lift truck on the flat bed of a trailer and have it be of minimal projection beyond the trailer surface.

An example of a fork lift truck having both retractable wheels and being mountable on a trailer is shown in each of U.S. Pat. Nos. 3,799,379; 4,061,237; and 4,921,075, although the latter does not show retractable wheels.

U.S. Pat. Nos. 3,972,427; 4,460,064; 4,571,139; and 4,613,272 disclose fork lift trucks of very specialized nature which have retractable or collapsible wheel structure combined with the feature of actually loading the fork lift truck onto the support surface of the trailer or other vehicle involved.

SUMMARY OF THE INVENTION

This invention involves a relatively small-sized fork lift truck, normally where the operator walks behind the truck and manually controls the operation thereof. It involves a caster wheel on the rear and two forwardly projecting support wheels to provide a three point, essentially triangular, support system for the truck. The caster wheel is power driven by hydraulic fluid operating through the caster axle.

The two front wheels are mounted on elongated arms which extend parallel to the tines of the fork. The arms are connected to the framework of the truck by a pair of sleeves which telescope over the ends of an axle projecting from each side of the frame.

At such times as the user desires to store the fork lift truck, he manually removes the forks and actuates a hydraulic system to pivot the forwardly extending arms and wheels to a vertical position with the arms straddling the upwardly extending mast. Alternatively, the arms may be raised manually.

Smaller, storage support wheels, are mounted on a rearwardly extending bracket on each of the sleeves. The brackets extend radially from the two sleeves in a direction essentially opposite to the extension of the forwardly extending arms.

The arms are caused to rotate vertically to decrease the forward part of the space taken up by the fork lift and by the structure of this invention, the upwardly extending arms are caused to contract inwardly toward the mast to reduce the transverse dimension of the lift truck when the arms are in upright storage position. This is accomplished by a motor and hydraulic system which provides the power to rotate each sleeve and thereby the forwardly extending arms. Each sleeve is caused to rotate and telescope inwardly over its associated axle by virtue of a radially extending lug on the surface of each axle end, which lug fits into a diagonally extending slot in each sleeve. The combination of lug and slot cams the sleeves inwardly on the axle as the arms rotate upward.

Objects of the invention not clear from the above will be understood fully by a review of the drawings and description of the preferred embodiment which follow.

DESCRIPTION OF THE PREFERRED EMBODIMENTS

Figure 1:
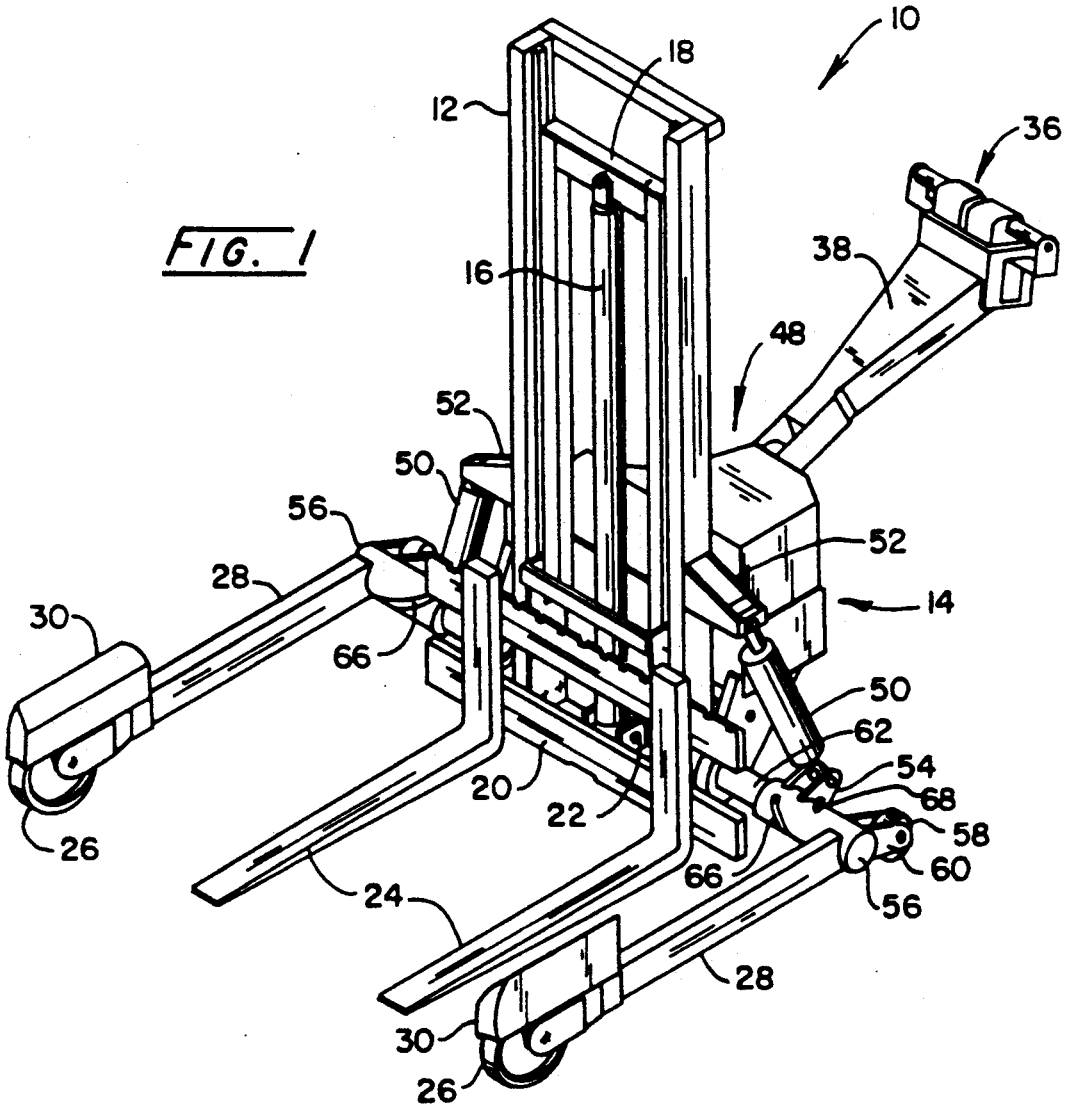
FIG. 1 is a perspective view of a fork lift truck according to this invention.

Looking to FIG. 1, a fork lift truck 10 according to this invention includes a mast 12 extending generally upward from a frame 14. Intermediate the two upwardly extended branches of mast 12 is a first piston and cylinder combination 16 connected to a yoke 18 which is a part of a general framework comprising a carriage 20. The mast 12 serves to guide the carriage 20 within a defined path of travel when hydraulic fluid actuates the piston and cylinder combination 16 to drive the carriage upward or downward. It is understood that the piston and cylinder combination may include a positive upward drive of hydraulic fluid and the descending aspect of the carriage may be accomplished by a positive downward drive of hydraulic fluid or merely an exhaust valve allowing the carriage to descend by gravity by merely opening the valve to allow the drainage of hydraulic fluid from the cylinder below the piston. Either mechanism will work and is within the contemplation of this invention.

The piston and cylinder combination 16 is connected to the framework 14 by a suitable hinged connection 22.

A pair of tines 24 extend forwardly from the carriage 20 as a part of the fork for the conventional purpose of engaging and lifting a product to be transported, the product is not shown for purposes of convenience. The tines may be removed from the carriage 20 if desired for storage or any other reason and they may be adjusted as to width in a suitable operative position as is well known in the art.

Figure 3:
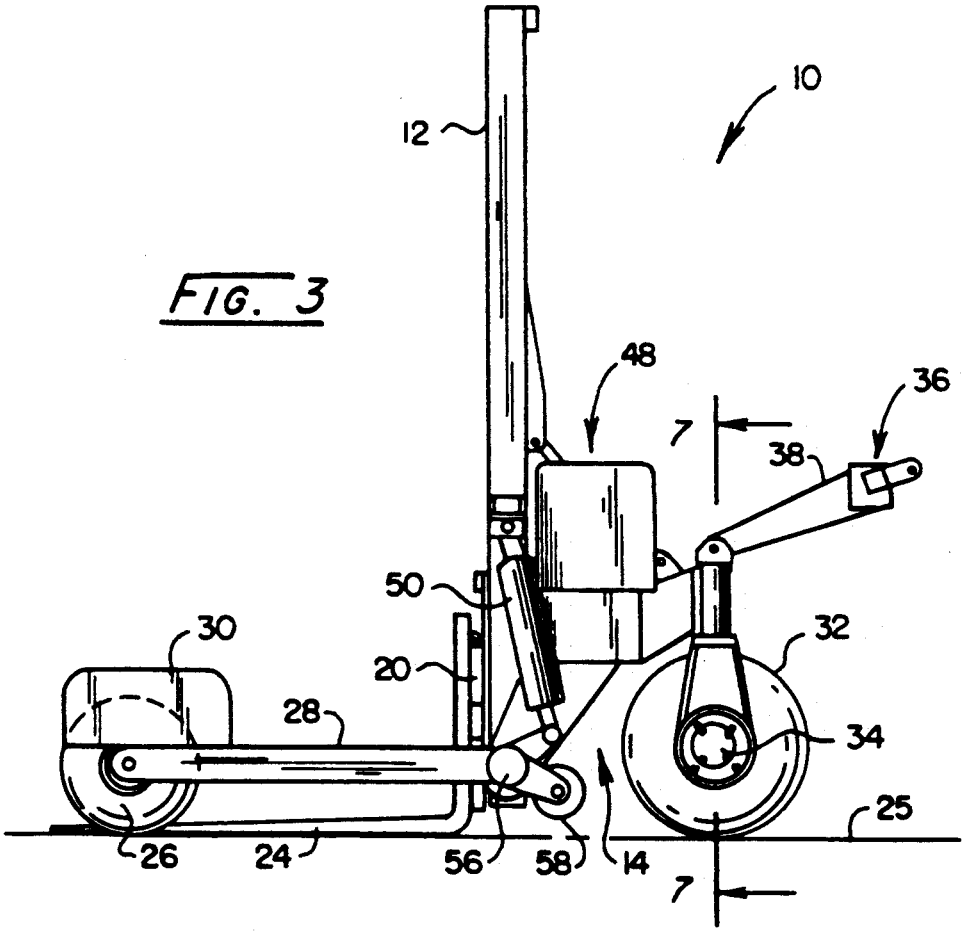
FIG. 3 is a right-hand side elevational view of the truck of FIG. 1 with the wheels in operative support position.

The fork lift truck 10 is supported on a substrate 25, see FIG. 3, by a pair of front wheels 26 mounted on the forward end of support arms 28. It will be observed that the upper surface of each wheel 26 is covered by a fender 30. It will be observed in FIG. 1 that each fender 30 has an upper surface which ends in a chisel point and the surface slops inward toward the tines 24. The reason for the fender 30 is to prevent product which is being transported by the truck from being engaged by the wheel 26 when the truck is moving and the wheel rotating. The detrimental effect of such contact is obvious, but the inwardly slopping surface may not be so obvious, it is to provide an inward bias to any product which may be on the truck, to push the product toward the center of the truck support system and away from the wheels. Specifically, the fender 30 prevents frictional engagement of product and wheels 26 and urges product toward the tines. Fenders 30 are clearly optional features of the truck 10.

Rear support of the truck is supplied by a caster wheel 32 (see FIGS. 3 and 4) which is supported on an axle. The caster axle is surrounded by a drive motor 34 to provide a power drive for the caster wheel when actuated by controls 36. Controls 36 are manually manipulable by an operator who may walk behind the fork lift. The operator is able to actuate the power drive of the system by hand operation and is able to steer the truck by the handle 38 which is directly connected to caster wheel 32. An automatic braking system 39 for the caster wheel 32 locks the wheel in place when the operator is not moving the truck. This safety feature will be explained in more detail in a discussion of FIGS. 12 and 13.

Figure 7:
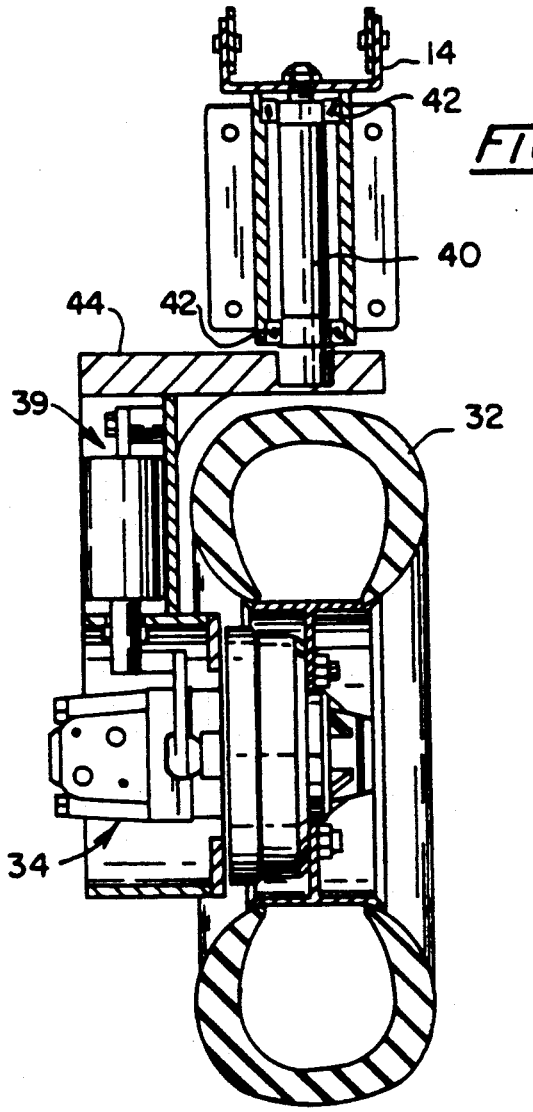
FIG. 7 is a sectional view taken along line 7—7 of FIG. 3.

Looking to FIG. 7, the caster wheel 32 is supported on the framework 14 through an upwardly extending rod 40 projecting into a set of roller bearings 42. The rod 40 is connected in turn with a housing 44 which includes an off set pivot connection and the drive motor 34.

Figure 8:
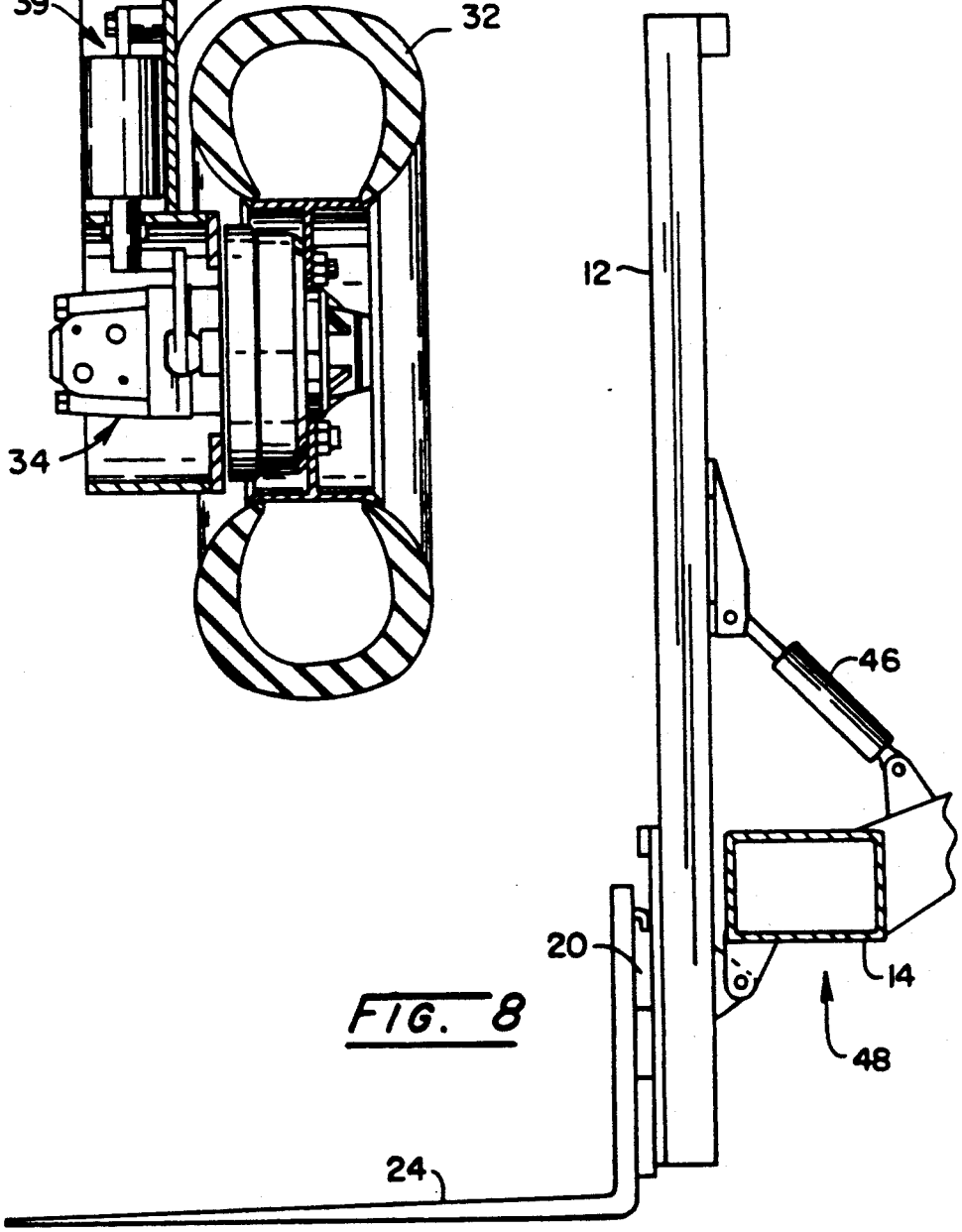
FIG. 8 is a fragmentary side elevational view of the mast and forks of the fork lift truck of this invention.

Looking to FIG. 8, framework 14 is connected to mast 12 in several ways including a second piston and cylinder combination 46 which serves to allow the operator to pivot the mast backward, to the right as illustrated in FIG. 8, and thereby, tilt the tines 24 upward after a suitable load is supported thereon. It is a safety feature which is known in the industry and it minimizes the likelihood that a product being transported will slide or roll off the tines upon a sudden stop of the truck for whatever reason.

The equipment indicated as being supported by the framework 14 on the rear of the truck intermediate the mast 12 and handle 38 includes a reservoir for hydraulic fluid and a drive motor to transmit hydraulic fluid to the various piston and cylinder combinations which have been and will subsequently be described in relation to the operation of this fork lift truck. The individual components on the rear of the fork lift truck have not been labeled or identified specifically because their particular configuration is not critical. For convenience, the reservoir, drive motor, etc. are identified by the numeral 48.

The hydraulic system and drive motor are operatively connected to a pair of piston and cylinder combinations 50, one on each side of the frame, which are connected between a bracket 52 projecting from the upwardly extending mast and another bracket 54 projecting radially from a projection or sleeve 56. Simultaneous actuation of the third piston and cylinder combinations 50 causes hydraulic fluid to drive the pistons out of the cylinder and thereby rotate the arms 28 and wheels 26 through a vertical arc to a position where they are essentially parallel with the mast 12.

Alternatively the piston and cylinder combination 50 may not be connected to the hydraulic system. The force used to raise arms 28 may be manual.

Each sleeve 56 includes a storage wheel unit 58 which is mounted in position on the periphery of the sleeve by a radially extending bracket 60.

Figure 2:
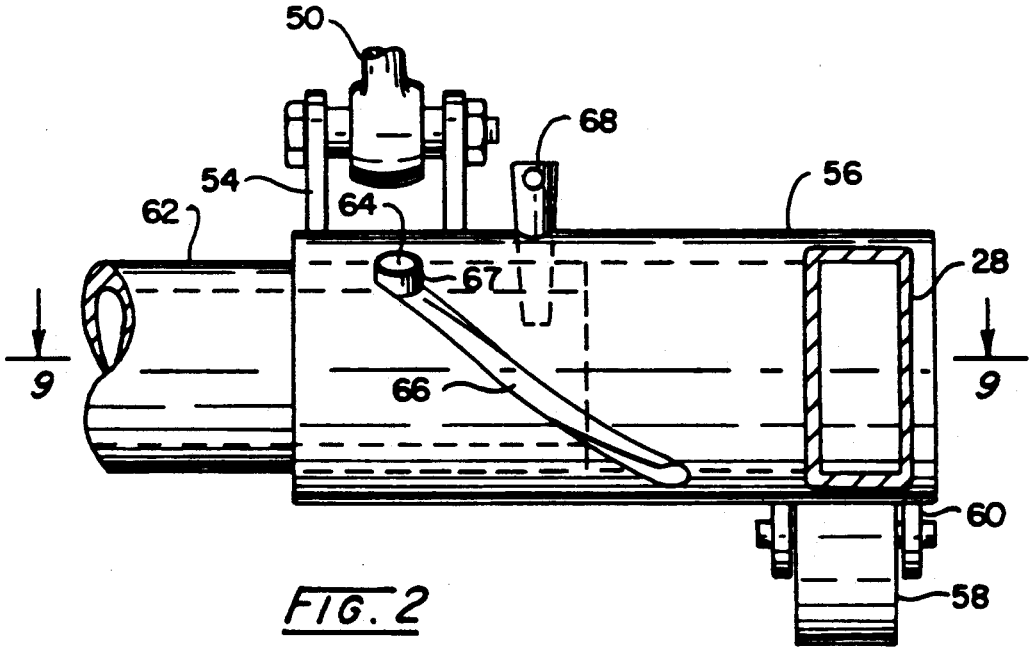
FIG. 2 is a fragmentary sectional view of the connecting apparatus between the axle of the truck and the support arms of the same.
Figure 9:
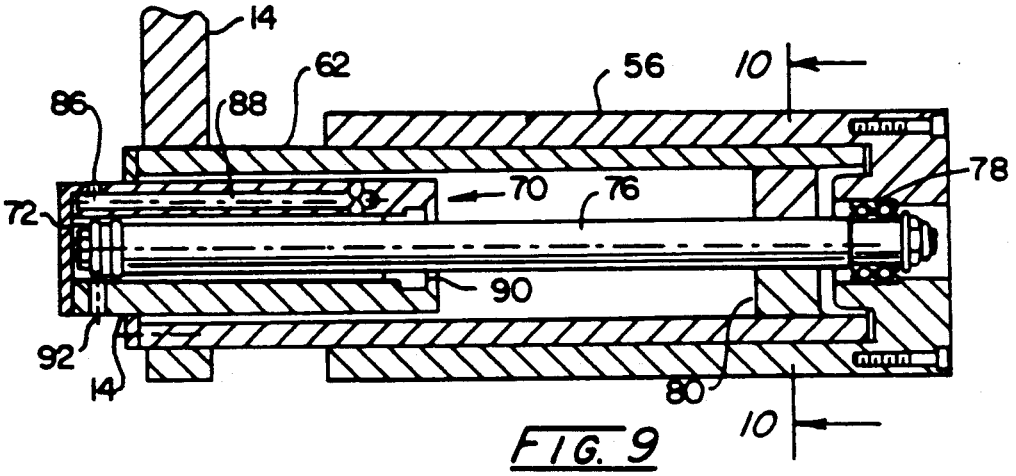
FIG. 9 is a fragmentary sectional view taken along line 9—9 of FIG. 2.
Figure 10:
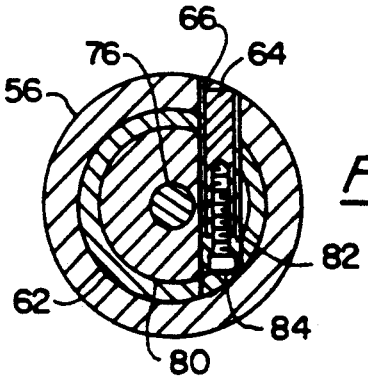
FIG. 10 is a sectional view taken along line 10—10 of FIG. 9.

An observation of FIGS. 2, 9, and 10 will show that each sleeve 56 is telescopingly mounted over a stub axle 62 which projects transversely from the frame 14. It will be observed that there are two separate axles 62 on the apparatus illustrated but there is no reason the axle could not extend completely across the framework and provide only one axle if desired. Note also that the preferred embodiment shows the sleeve 56 telescoping over the exterior of axle 62. The reverse could be true if desired.

A lug 64 is shown projecting radially from a surface of axle 62 into a diagonally extending slot 66 in the surface of sleeve 56. The embodiment shown in FIG. 2 is with the wheel 26 and arm 28 in operative support position as illustrated in FIG. 1. It will be observed that there is a slight parallel jog at 67 in the slot 66 of FIG. 2 to accommodate the lug 64 when the support wheel 26 is in operative support position. It provides a little better frictional engagement to prevent an accidental pivoting of the arm 28 upward during operation, and a second safety feature is provided in the form of a tapered peg 68 projecting through mating holes in the sleeve 56 and axle 62 to further prevent accidental pivoting.

In the preferred embodiment a plate (not shown) covers slot 66 to prevent the accumulation of debris. Also, the peg 68 may be secured in a spring biased manner to sleeve 56 to minimize it being accidentally dislodged.

Looking particularly to FIGS. 9 and 10, a fourth piston and cylinder combination 70 is illustrated and its purpose is to assist the third piston and cylinder combinations 50 in their rotation of the sleeve 56, as will be explained subsequently. Piston and cylinder combination 70 includes a piston 72 housed in a cylinder 74. Piston 72 is connected to an elongated piston rod 76 which extends beyond cylinder 74 to a bearing race 78. This combination allows the piston 72, piston rod 76, and sleeve 56 to reciprocate axially as a unit while at the same time allowing sleeve 56 to rotate with respect to axle 62 by virtue of the bearing race 78.

A guide block 80 is mounted on the interior of the axle 62 to assist in guiding and aligning piston rod 76 in its reciprocation but it serves another function as best illustrated in FIG. 10. Block 80 is pined against rotation with respect to axle 62 by a pin 82 which is press fitted into place. A cap screw 84 is threaded into the pin 82 in stationary position and serves as the male part of a threaded connection with lug 64. In assembly, the axle 62 and sleeve 56 are telescoped together and then the lug 64 is inserted through slot 66 and into the pin where it is threaded onto the cap screw 84 to lock the sleeve 56 and axle 62 together in operative position.

Figure 13:
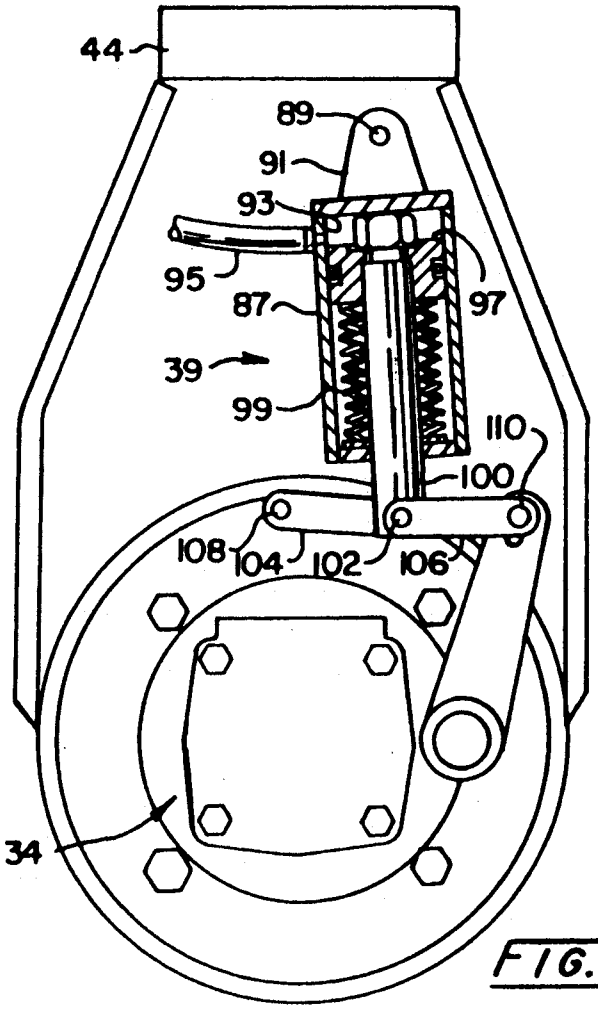
FIG. 13 is a side elevational view of FIG. 7 with the brake applied.
Figure 12:
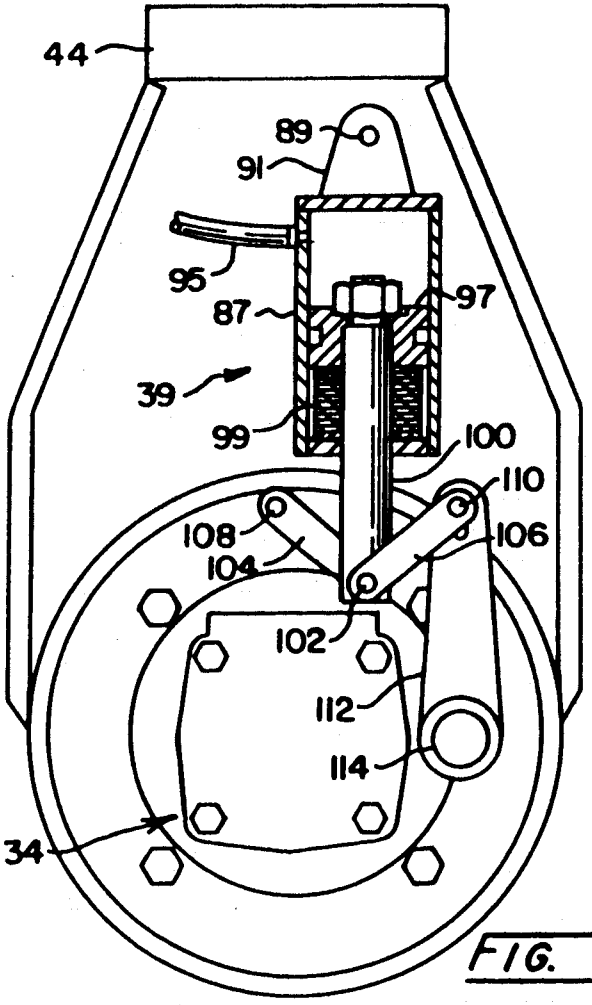
FIG. 12 is a side elevational view of FIG. 7 with the brake in released position.

Looking to FIGS. 12 and 13, housing 44 covers an automatic braking system 39. The system includes a cylinder 87 suspended on a peg 89 by an upwardly extending bracket 91. The suspension allows cylinder 87 to pivot about peg 89 in a vertical plane.

An opening 93 near the top of cylinder 87 is connected to a hose 95. Hose 95 connects the interior of the cylinder to the hydraulic fluid driving the motor 34. Fluid entering cylinder 87 drives piston 97 downward against the bias of a plurality of belville springs 99. Springs 99 circumscribe a piston rod 100 which is pivotally connected at its lower end to a pin 102. Pin 102 serves as an axle for rod 100 and two links 104 and 106, all being pivotally attached to pin 102. One end of link 104 is pivotally mounted over a stationary pin 108. The distal end of link 106 is pivotally mounted over pin 110 which projects through an opening in lever 112. The lower end of lever 112 is secured to a rod 114 which projects into the housing of motor 34. A brake shoe (not shown) engages a drum around the axle of wheel 32 when the hydraulic system is not activated to drive motor 34 to thereby automatically brake the wheel. This is a safety feature whereby the braking system is always automatically locked when the motor 34 is not operating, as seen in FIG. 13.

When the operator is manipulating controls 36, fluid surges through hose 95 and into the cylinder 87 to drive piston 97 downward against springs 99. Thereby rod 100, in combination with links 104, 106, pivots lever 112 which serves to release the brake, as seen in FIG. 12. This allows wheel 32 to rotate and move the fork lift in response to hydraulic fluid delivered to motor 34.

In operation, the operator will grasp the controls 36 and depress the handle 38 as needed and will urge the fork lift to whatever lifting and moving operation is required in the orientation illustrated in FIG. 1.

After the operator has completed using the fork lift truck, it is transported to a storage area. Then the tines 24 is removed from carriage 20 and stored separately. Then simultaneous actuation of third piston and cylinder combination 50 and fourth piston and cylinder combination 70 through controls 36 delivers hydraulic fluid under pressure to piston and cylinder combination 50 causing the combination to rotate the sleeve 56 and raise wheels 26 and arms 28 through an arc until the arms 28 are essentially parallel with mast 12. Where there is no hydraulic connections to lift arms 28 they are lifted manually.

Simultaneously with the actuation of piston and cylinder combination 50, the system may feed hydraulic fluid under pressure through an inlet 86, see FIG. 9, and along a passage 88 in the wall of cylinder 74 to the interior of the cylinder where it will exert pressure on piston 72 to move it to the left as seen in FIG. 9 and thereby urge sleeve 56 to the left. It should be emphasized that this is not required because piston and cylinder combinations 50 should provide adequate power, but it is an option if desired. Note that the seal 90 surrounding piston rod 76 will prevent hydraulic fluid from leaking from the cylinder 74.

During the rotation of sleeve 56, pin 64 cams sleeve 56 to rotate and translate in telescoping relationship with axle 62 by acting against the surface of slot 66. As is obvious, the tapered safety pin 68 is removed before piston and cylinder combinations 50 are actuated.

Figure 4:
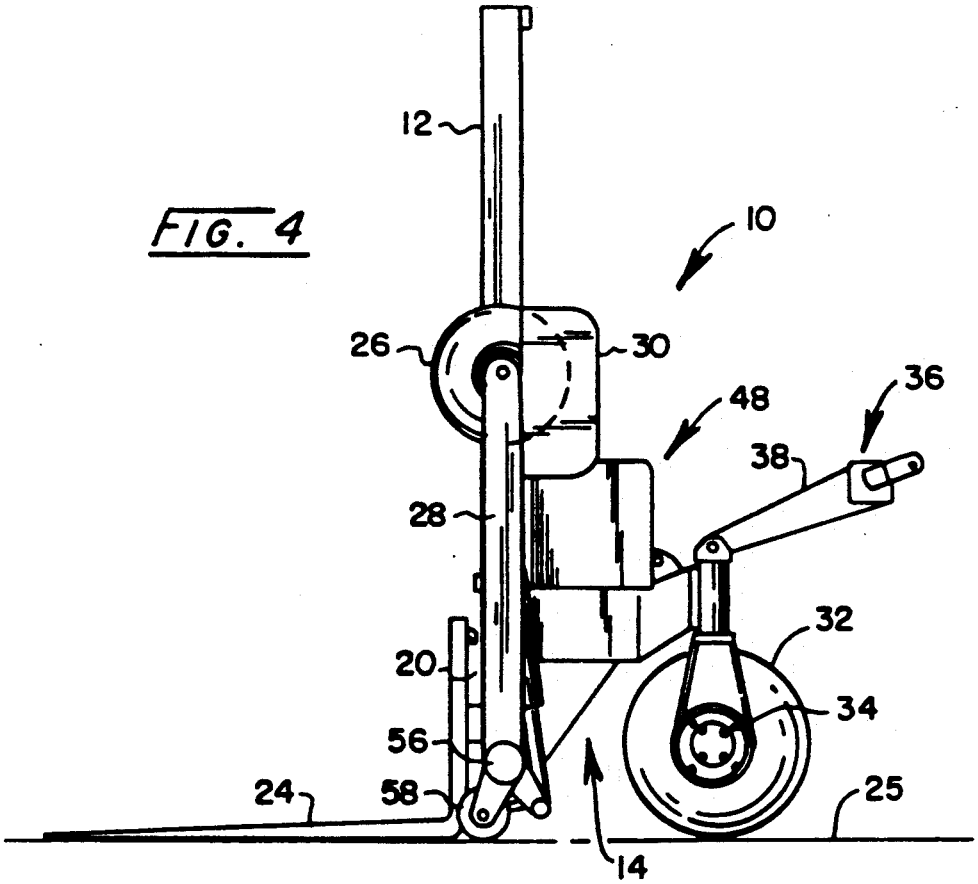
FIG. 4 is a side elevational view of the fork lift truck of this invention but with the support wheels rotated to inoperative storage position.
Figure 5:
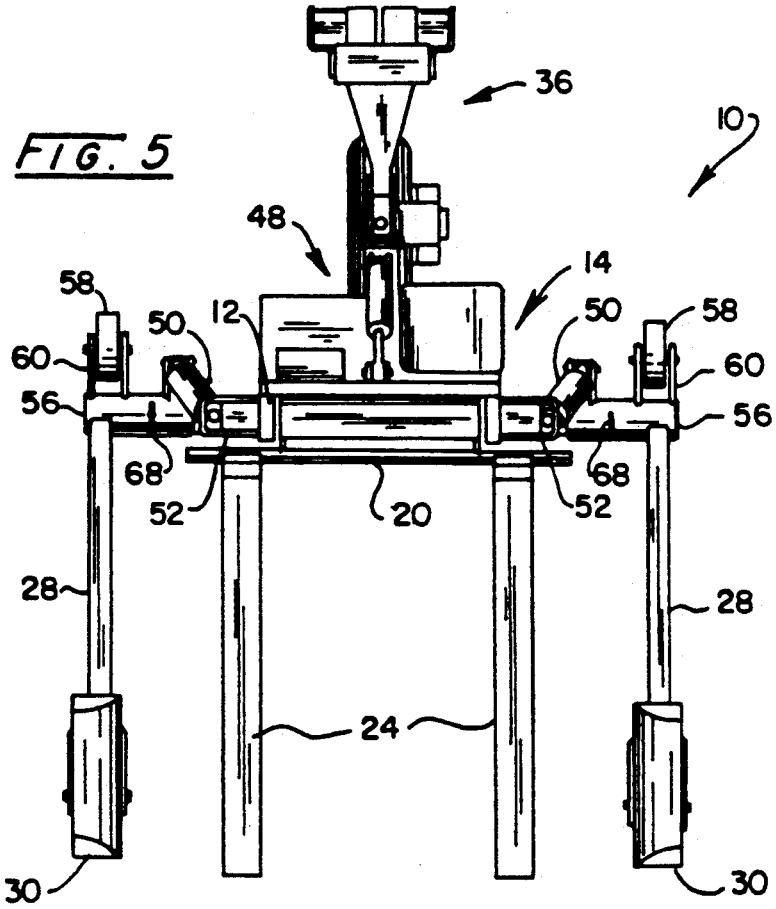
FIG. 5 is a top plan view of the fork lift truck of FIG. 3.
Figure 6:
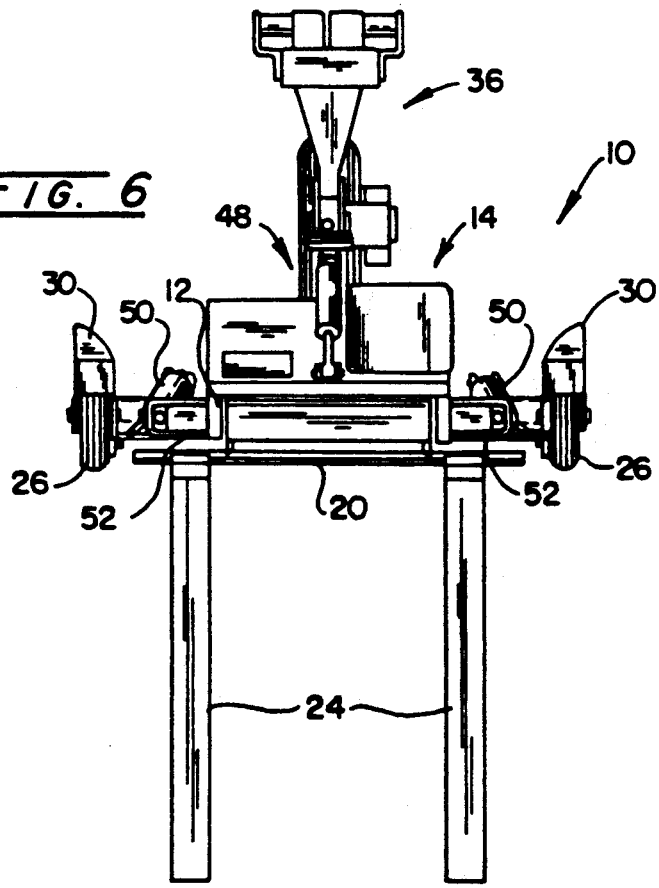
FIG. 6 is a top plan view of the fork lift truck of FIG. 4.
Figure 11:
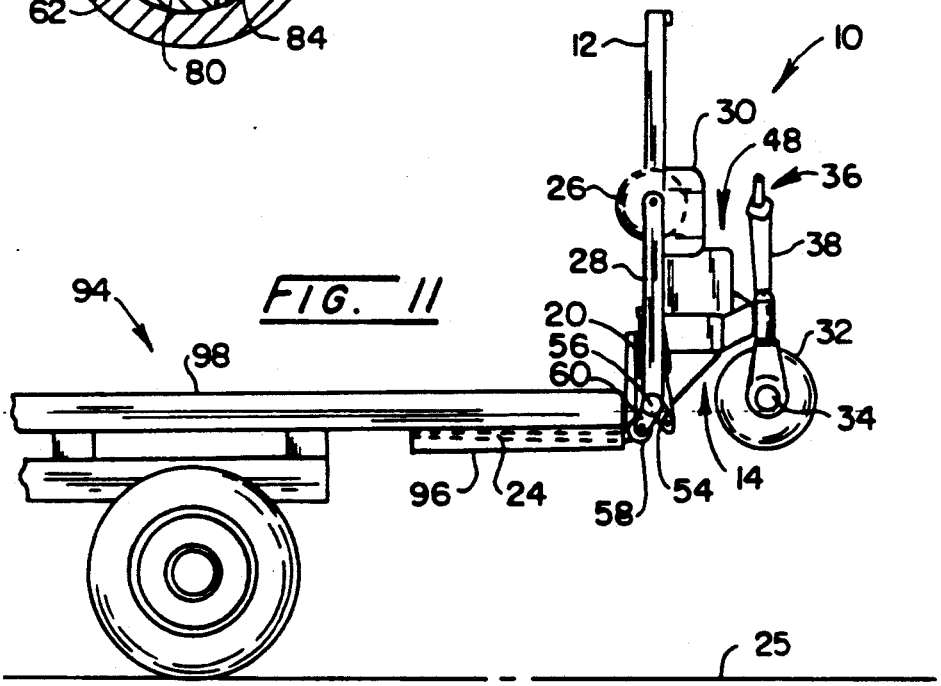
FIG. 11 is a fragmentary side elevational view of the fork lift truck of this invention in storage position and mounted on a trailer.

When sleeve 56 rotates, the tines must be on the substrate 25 to prevent the fork lift truck from tilting forward as the wheels 26 leave the substrate. This is best illustrated in FIG. 4. The three point triangular support system provides good stability during normal operations on relatively flat surfaces and while the truck is operating under normal conditions. However, the wide spaced triangular three point support system is unnecessary when the truck is in storage against a warehouse wall. Accordingly, the storage wheels 58 are mounted on brackets 60 in positions such that they engage substrate 25 to provide an alternative three point support stance for the truck, (1) after the tines 24 are removed, (2) the truck is pushed against a wall and (3) the handle 28 is lifted to a vertical position as shown in FIG. 11. In that condition the truck takes up very little floor space. Once it is needed again operations will be reversed, namely, the handle 38 is tilted downward, the truck removed from against the wall, the tines installed in place on the carriage and pressed to their lower position, then the hydraulic system is reversed.

In the preferred embodiment, the third piston and cylinder combinations 50 are one-way acting pistons and have no positive drive to turn the sleeves 56 to rotate the arms 28 downward to the horizontal position. It could be otherwise, but it is a more expensive design. To accommodate this minimal need to start the rotation of the arm 28 downward, since it is in near gravity neutral position in storage, a second inlet 92, see FIG. 9, is provided through the sidewall of cylinder 74 and in this case on the left-hand side of piston 72. Hydraulic fluid is fed through second inlet 92 to drive piston 72 to the right and thereby rotates sleeve 56 and lug 64 cams the structure into place. Little force is required to accomplish this purpose because gravity is an assist as the wheels 26 rotate downward.

Looking now to FIG. 11, it will be observed that the fork lift truck of this invention may be mounted on the front or rear end of a trailer 94 by the following procedure. First the tines 24 is inserted into pockets 96 on the underside of the support bed 98 of the trailer. Then the controls 36 are actuated to bring tines 24 down (which has the effect of lifting the fork lift truck up to the position shown in FIG. 11). Thereby, the fork lift truck may be transported to another site to be used in unloading the trailer, if desired. It is clear that the arms 26 should be rotated to storage position prior to the time the fork lift is actuated to lift itself into the position shown. Those having ordinary skill in the art will understand exactly how to accomplish the desired result. What may not be so obvious is the fact that the compact profile resulting from the previously described storage operations allows the fork lift truck to be stored on either the front or rear edges of the trailer 94. The fact that the truck is retracted longitudinally and compressed transversely allows it to fit into place between the front of the trailer and the tractor without preventing normal turning of the tractor-trailer during normal operations and with complete safety. The illustrated embodiment shows the fork lift truck mounted on the rear of a trailer, but it should be understood that it could be mounted on the front of the trailer without problems.

Having thus described the invention in its preferred embodiment, it will be clear that modifications may be made to the structure without departing from the spirit of the invention. Accordingly, it is not intended that the language of the specification nor the drawings illustrating the same be limiting on the invention. It is intended that the invention be limited only by the scope of the appended claims.

We claim:

1. A fork lift truck including three wheels, said wheels being spaced apart from each other to provide a generally triangular three point support for said truck on a substrate, means for propelling said truck in a forward direction and means for lifting at least one of said wheels out of contact with said substrate while moving a fourth wheel into contact with said substrate to modify the generally triangular pattern of said three point support, said truck comprising, a mast projecting upwardly and parallel with a first piston and cylinder combination, a carriage connected to said piston and mast which control its vertical reciprocation, said piston being connected to said carriage to drive it upward in response to hydraulic fluid entering said cylinder below said piston, said carriage supporting a forwardly projecting tine which is configured to engage and lift some product as desired in response to the vertical movement of said tine, two of said wheels being mounted on two forwardly extending, parallel support arms, one support arm being located on each side of said tine, a first axle mounted on a frame, said frame supporting (1) said cylinder, (2) said mast, (3) a hydraulic motor, (4) a means to drive said hydraulic motor and (5) a means for controlling said motor and drive means, said frame being partially supported above said substrate by the third of said wheels, said third wheel including a second axle, said second axle being mounted in a housing, said housing being connected to a vertically extending pivot rod, said pivot rod projecting into engagement with a bearing seat on said frame to allow said pivot rod, housing, axle, and third wheel to rotate about an axis through said rod and said seat, said housing including a hydraulic means to rotate said third wheel and thereby drive said truck forward, said hydraulic means being operatively connected to receive hydraulic fluid from said hydraulic motor, at least one said arm being mounted on a projection at one end of the first axle, said projection including a diagonally extending slot, said axle and projection being mounted in telescoping relationship, a lug projecting from a surface of an end of said axle, said lug projecting into said slot, means for rotating said projection with respect to said axle to thereby lift the wheel on the arm and projection combination from the substrate into a position where the lifted arm is more parallel with said mast while simultaneously moving the rotating arm transversely with respect to said frame, said fourth wheel being mounted on a bracket projecting radially from said projection, said bracket and fourth wheel being mounted on said projection to move said fourth wheel into engagement with said substrate after the wheel on the rotating arm lifts its associated wheel from contact with the substrate.

2. The truck of claim 1 wherein said projection is a sleeve, each arm includes a slotted sleeve on one end and each end of the first axle includes a lug mating with one of the slots in the adjacent sleeve, each sleeve including a bracket with a fourth wheel thereby providing two fourth wheels, said means for controlling said motor and drive means comprising a manually activated handle with control apparatus for rotating the sleeves and the third wheel and driving the piston upward.

3. The truck of claim 2 wherein one lug on said first axle is stationary with respect to said frame, said slot which is penetrated by said stationary lug being configured to move the sleeve closer to said frame upon rotation of said sleeve to lift its associated arm toward said mast.

4. The truck of claim 3 including a second piston and cylinder combination connected between said frame and said mast to allow tilt of said mast backward, toward said frame, prior to the time the tine is lifted to support said product.

5. The truck of claim 4 wherein the means for rotating said sleeve comprises a third piston and cylinder combination connected between a bracket projecting from said mast and a second bracket projecting from said sleeve.

6. The truck of claim 5 including a fender extending over and partially covering each wheel on each arm, said fender preventing most contact between the covered wheel and said product.

7. The truck of claim 6 wherein the fenders include an upper surface sloping toward the tine.

8. The truck of claim 1 including a second piston and cylinder combination connected between said frame and said mast to allow tilt of said mast backward, toward said frame, prior to the time the tine is lifted to support said product.

9. The truck of claim 8 wherein the means for rotating said projection comprises a third piston and cylinder combination connected between a bracket projecting from said mast and a second bracket projecting from said projection.

10. The truck of claim 9 including a fender extending over and partially covering each wheel on each arm, said fender preventing most contact between the covered wheel and said product.

11. The truck of claim 10 wherein the fenders include an upper surface sloping toward the tine.

12. The truck of claim 1 including a second piston and cylinder combination connected between said frame and said mast to allow tilt of said mast backward, toward said frame, prior to the time the tine is lifted to support said product.

13. The truck of claim 12 wherein the means for rotating said projection comprises a third piston and cylinder combination connected between a bracket projecting from said mast and a second bracket projecting from said projection.

14. The truck of claim 13 including a fender extending over and partially covering each wheel on each arm, said fender preventing most contact between the covered wheel and said product.

15. The truck of claim 14 wherein the fenders include an upper surface sloping toward the tine.

16. The truck of claim 2 including a second piston and cylinder combination connected between said frame and said mast to allow tilt of said mast backward, toward said frame, prior to the time the tine is lifted to support said product.

17. The truck of claim 16 wherein the means for rotating said projection comprises a third piston and cylinder combination connected between a bracket projecting from said mast and a second bracket projecting from said projection.

18. The truck of claim 17 including a fender extending over and partially covering each wheel on each arm, said fender preventing most contact between the covered wheel and said product.

19. The truck of claim 1 including means for applying a braking action to said third wheel when said third wheel is not rotating.

20. Apparatus for rotating a support arm of a fork lift truck to reduce the horizontal cross-sectional space covered by said truck comprising, said support arm having a support wheel at one end of said arm and a transversely extending sleeve at the other end, said sleeve being telescopingly fitted with an axle on said truck, said axle having a horizontal axis and being secured in non-rotating, non-translating position with respect to said truck, a lug projecting radially from the surface of said axle, said sleeve having a coextensive axis with said axle and being configured to move on said axle both rotationally and axially, said sleeve having a diagonally extending slot in its surface and said lug projecting into said slot, said axle being hollow and having a hydraulic cylinder coaxially aligned and secured within said hollow, one end of said cylinder extending away from said truck and having an opening therethrough, a piston within said cylinder having a piston rod on one end thereof projecting through said opening, seal means in said opening for sealing around said rod to prevent the escape of hydraulic fluid from said cylinder, the end of the rod projecting from said cylinder being connected to said sleeve by means to prevent relative axial movement between them while allowing relative rotational movement, means for delivering hydraulic fluid into said cylinder to exert force against said piston, thereby (1) moving said piston rod axially, (2) moving said sleeve axially, and (3) rotating said sleeve and arm about said axis by the camming action between the lug and slot.

* * * * *